US009145666B2

(12) United States Patent
Hammer

(10) Patent No.: US 9,145,666 B2
(45) Date of Patent: Sep. 29, 2015

(54) MAGNETICALLY ACTIVATED SWITCH ASSEMBLY FOR FOOD WASTE DISPOSER

(75) Inventor: Randall E. Hammer, Muskego, WI (US)

(73) Assignee: Emerson Electric Co., St. Louis, MO (US)

( * ) Notice: Subject to any disclaimer, the term of this patent is extended or adjusted under 35 U.S.C. 154(b) by 348 days.

(21) Appl. No.: 13/611,130

(22) Filed: Sep. 12, 2012

(65) Prior Publication Data

US 2014/0070036 A1 Mar. 13, 2014

(51) Int. Cl.

| | |
|---|---|
| ***E03C 1/266*** | (2006.01) |
| ***B02C 18/00*** | (2006.01) |
| ***B02C 25/00*** | (2006.01) |

(52) U.S. Cl.

CPC ..... *E03C 1/2665* (2013.01); *B02C 18/0084* (2013.01); *B02C 18/0092* (2013.01); *B02C 25/00* (2013.01)

(58) Field of Classification Search

CPC . E03C 1/2665; E03C 1/22; B02C 2018/0023; B02C 23/00; A61L 11/00

USPC ..... 241/46.013–46.016

See application file for complete search history.

(56) References Cited

U.S. PATENT DOCUMENTS

| | | | |
|---|---|---|---|
| 2,185,037 | A | 12/1939 | Powers |
| 2,544,745 | A | 3/1951 | Ashbaugh et al. |
| 2,565,322 | A | 8/1951 | Powers |
| 2,588,182 | A | 3/1952 | Van Ranst |
| 2,594,250 | A | 4/1952 | Tranbarger |
| 2,619,654 | A | 12/1952 | Coss |
| 2,669,395 | A | 2/1954 | Swisher |
| 2,719,011 | A | 9/1955 | Bebinger |
| 2,724,560 | A | 11/1955 | Tull |

(Continued)

FOREIGN PATENT DOCUMENTS

| | | | |
|---|---|---|---|
| CN | 200975000 | Y | 11/2007 |
| CN | 102284332 | A | 12/2011 |

(Continued)

OTHER PUBLICATIONS

Invitation to Pay Additional Fees for PCT/US2013/057917 mailed Nov. 6, 2013.

(Continued)

*Primary Examiner* — Faye Francis
*Assistant Examiner* — Onekki Jolly
(74) *Attorney, Agent, or Firm* — Harness, Dickey & Pierce, P.L.C.

(57) ABSTRACT

An apparatus for selectively activating a food waste disposer for a sink may include a housing and an activation member. The housing may include a switch and a first magnet. The first magnet may be movable relative to the housing and the switch between first and second positions. Movement of the first magnet from the second position to the first position may cause corresponding movement of the switch from an off-position in which electrical current is prevented from reaching a motor of the disposer to an on-position allowing electrical current to the motor. The activation member may include a second magnet and is receivable in a tubular member through which waste drains and positionable relative to the tubular member to place the second magnet in proximity to the first magnet to generate a repulsive magnetic force that moves the first magnet between the first and second positions.

14 Claims, 13 Drawing Sheets

(56) References Cited

U.S. PATENT DOCUMENTS

| | | | | |
|---|---|---|---|---|
| 2,742,236 | A | 4/1956 | Sutton | |
| 2,767,927 | A | 10/1956 | Green | |
| 2,781,175 | A | 2/1957 | Metzger | |
| 2,782,997 | A | 2/1957 | Wolff | |
| 2,794,602 | A | 6/1957 | Tull | |
| 2,819,028 | A * | 1/1958 | Moore et al. | 241/46.015 |
| 2,860,834 | A | 11/1958 | Hammes | |
| 2,917,246 | A | 12/1959 | Wiezcorek | |
| 2,946,522 | A | 7/1960 | Green | |
| 2,979,274 | A | 4/1961 | Tull | |
| 3,025,007 | A | 3/1962 | Wieczorek | |
| 3,084,877 | A | 4/1963 | Bebinger | |
| 3,142,448 | A | 7/1964 | Hogue | |
| 3,286,936 | A | 11/1966 | McMahon | |
| 3,288,381 | A | 11/1966 | Bell | |
| 3,291,399 | A | 12/1966 | Shepherd | |
| 3,358,702 | A | 12/1967 | Schaap | |
| 3,361,370 | A | 1/1968 | Shepherd | |
| 3,374,958 | A | 3/1968 | Shive | |
| 3,386,668 | A | 6/1968 | Shepherd | |
| 3,409,234 | A | 11/1968 | Smith | |
| 3,430,871 | A * | 3/1969 | Ross | 241/32.5 |
| 3,504,863 | A * | 4/1970 | Ross et al. | 241/32.5 |
| 3,695,519 | A | 10/1972 | Bebinger | |
| 3,768,744 | A | 10/1973 | Bebinger | |
| 3,804,341 | A | 4/1974 | Guth | |
| 4,310,933 | A * | 1/1982 | Stratman | 241/46.015 |
| 4,337,901 | A | 7/1982 | Ogura | |
| 5,539,166 | A | 7/1996 | Reier | |
| 5,721,411 | A | 2/1998 | Ervin | |
| 6,082,643 | A * | 7/2000 | Kovacs | 241/36 |
| D537,673 | S | 3/2007 | Anderson et al. | |
| 7,201,337 | B1 | 4/2007 | Feola | |
| 7,360,729 | B2 | 4/2008 | Anderson et al. | |
| 7,500,626 | B2 * | 3/2009 | Berger et al. | 241/32.5 |
| 7,503,514 | B2 | 3/2009 | Berger et al. | |
| 7,584,914 | B2 | 9/2009 | Nishikawa et al. | |
| 7,754,981 | B2 | 7/2010 | Arakawa et al. | |
| 7,757,981 | B2 * | 7/2010 | Anderson et al. | 241/32.5 |
| 7,954,739 | B2 | 6/2011 | Shin-Ya | |
| 2004/0178289 | A1 * | 9/2004 | Jara-Almonte et al. | 241/46.016 |
| 2007/0290084 | A1 | 12/2007 | Ootsuka et al. | |
| 2008/0301871 | A1 * | 12/2008 | Hanson et al. | 4/695 |

FOREIGN PATENT DOCUMENTS

| | | | |
|---|---|---|---|
| CN | 202070541 | U | 12/2011 |
| CN | 202117128 | U | 1/2012 |
| EP | 1961496 | A1 | 8/2008 |
| EP | 2248608 | A1 | 11/2010 |
| GB | 1153612 | A | 5/1969 |
| JP | 2004337788 | A | 12/2004 |

OTHER PUBLICATIONS

International Search Report and Written Opinion of the International Searching Authority for PCT/US2013/057917 dated Feb. 12, 2014.

* cited by examiner

MAGNETICALLY ACTIVATED SWITCH ASSEMBLY FOR FOOD WASTE DISPOSER

FIELD

The present disclosure relates to a food waste disposer, and more particularly, to a magnetically activated switch assembly for a food waste disposer.

BACKGROUND

This section provides background information related to the present disclosure and is not necessarily prior art.

A food waste disposer may be mounted underneath a sink to receive liquid and food waste that passes through a drain of the sink. The food waste disposer may grind the food waste into particles that are small enough to be passed through a plumbing system connected to the drain without clogging or otherwise damaging the plumbing system.

A typical food waste disposer may include a food conveying section, a motor section and a central grinding section disposed between the food conveying section and the motor section. The food conveying section conveys the food waste to the central grinding section. The grinding section typically has a shredder plate that is rotated relative to a stationary grind ring by an electric motor of the motor section. The motor has a rotor having a rotatable shaft coupled to the shredder plate. The electric motor can be an induction motor or any other suitable type of motor, such as a brushless motor, universal motor, or switched reluctance motor, for example.

A batch-feed food waste disposer, as opposed to a continuous-feed food waste disposer, operates by grinding a discrete quantity of food waste before more food waste can be inserted into the food waste disposer. That is, a user may fill the disposer with a quantity or batch of food waste, then at least partially block the drain opening with an activation member or stopper before a motor of the disposer can be operated to grind the food waste in the manner described above. Removing the activation member from the drain opening will deactivate the motor and will allow the user to insert a subsequent batch of food waste into the disposer and repeat the above process. Examples of switch assemblies for a batch-feed food waste disposer are disclosed in U.S. Pat. No. 7,500,626 for "Switching Mechanism for a Batch Feed Waste Disposer" issued Mar. 10, 2009 and in U.S. Pat. No. 7,757,981 for "Switching Assembly for a Batch Feed Waste Disposer" issued Jul. 20, 2010. The entire disclosures of these two patents are incorporated herein by reference.

SUMMARY

This section provides a general summary of the disclosure, and is not a comprehensive disclosure of its full scope or all of its features.

In one form, the present disclosure provides an apparatus for selectively activating a food waste disposer system for a sink. The apparatus may include a housing and an activation member. The housing may include a switch and a first magnet. The first magnet may be movable relative to the housing and the switch between a first position and a second position. Movement of the first magnet from the second position to the first position may cause corresponding movement of the switch from an off-position in which electrical current is prevented from reaching a motor of the food waste disposer system to an on-position allowing electrical current to the motor. The activation member may include a second magnet and may be adapted to be at least partially received in a tubular member through which waste drains from the sink and positioned relative to the tubular member in a manner that places the second magnet in sufficiently close proximity to the first magnet to generate a repulsive magnetic force that moves the first magnet from the second position to the first position.

In another form, the present disclosure provides a food waste disposer system for a sink that may include a disposer unit, a tubular member, a switch unit, an activation member, a track and a protrusion. The disposer unit may include a grinding mechanism and a motor drivingly connected to the grinding mechanism. The tubular member couples to an inlet of a food conveying section of the disposer unit and is securable to a sink flange, extends between the inlet of the food conveying section and the sink flange, and communicates waste from the sink into the disposer unit. The switch unit may be mounted to the tubular member and may include a first magnet that is movable relative to the tubular member between a first position in which the switch unit is in a first state allowing activation of the motor and a second position in which the switch unit is in a second state preventing activation of the motor. The activation member may be at least partially receivable within the tubular member for relative rotation therebetween. The activation member may include a second magnet positioned such that rotational alignment between the first and second magnets causes the first magnet to move to the first position. The track may include a detent and may be formed on one of a radially outer surface of the activation member and an inner circumferential portion of the tubular member. The protrusion may be formed on the other of the radially outer surface of the activation member and the inner circumferential portion of the tubular member. The protrusion may be adapted to slidably engage the track to facilitate relative rotation between the activation member and the tubular member and may be at least partially receivable in the detent to rotationally align the first and second magnets.

In another form, the present disclosure provides a device adapted to retrofit a batch-feed switch system onto a continuous-feed food waste disposer. The food waste disposer may include an inlet portion including a tubular body and a flange portion extending radially outward from the tubular body. The batch-feed switch system may include an extension tube having a plurality of protuberances extending therefrom. The device may include a generally annular body having a plurality of slots receiving the plurality of protuberances to removably secure the device to the extension tube. The annular body may be adapted to engage the inlet portion such that the annular body of the device extends around the tubular body of the inlet portion.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 1:
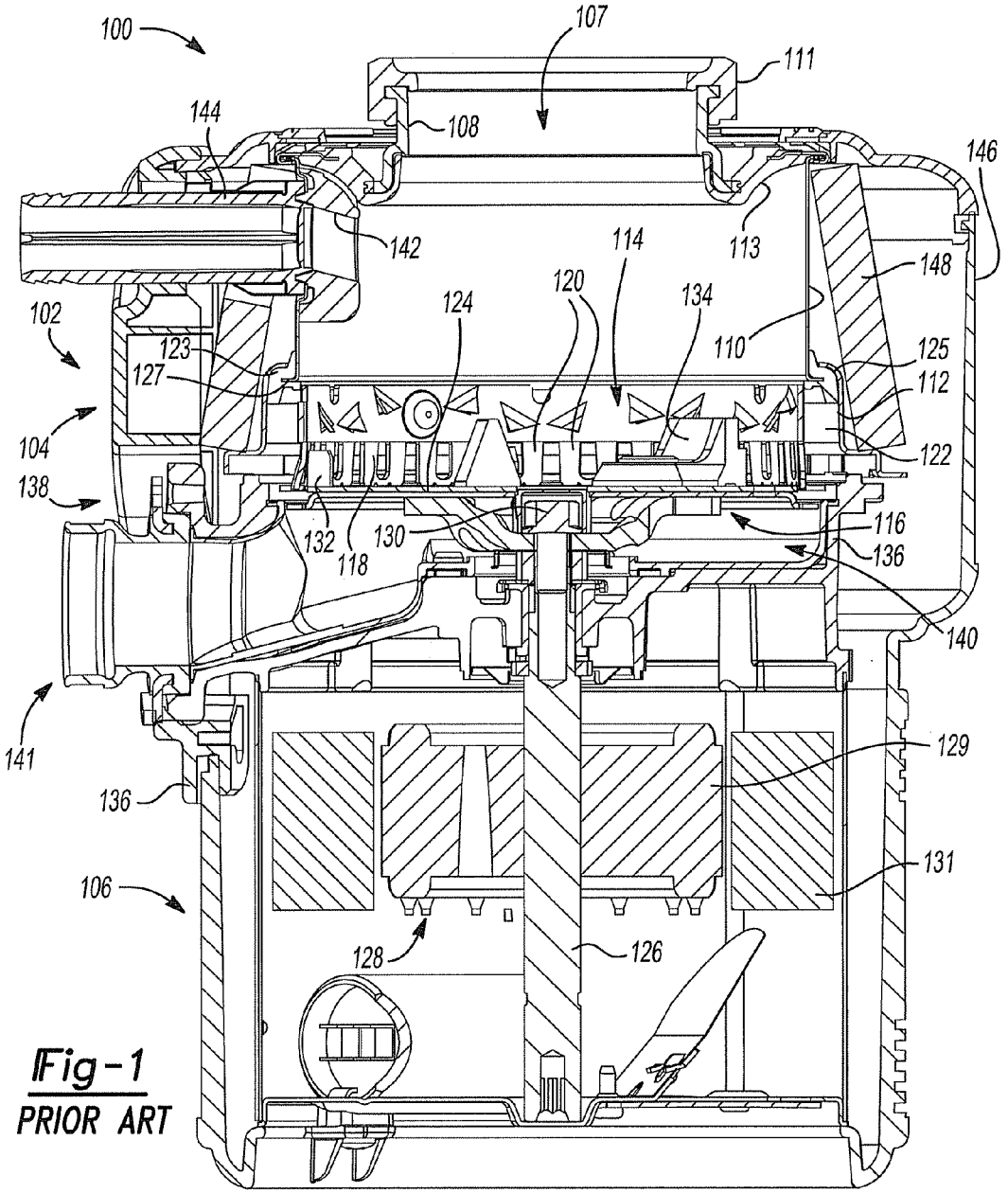
Fig-1 PRIOR ART
FIG. 1 is a cross-sectional view of an exemplary disposer unit.

FIG. 1 depicts a prior art food waste disposer 100 which can be mounted for communication with a drain opening of a sink (not shown). The food waste disposer 100 can be similar to the food waste disposer described in U.S. Pat. No. 7,360,729, the entire disclosure of which is incorporated herein by reference. The disposer 100 may include an upper food conveying section 102, a central grinding section 104 and a motor section 106, which may include a variable speed motor. It should be understood that motor section 106 could also include a fixed speed motor, such as an induction motor. The central grinding section 104 is disposed between the food conveying section 102 and the motor section 106.

The food conveying section 102 conveys the food waste to the central grinding section 104. The food conveying section 102 may include an inlet housing 108 and a conveying housing 110. The inlet housing 108 may include an inlet 107 at an upper end of the disposer 100 for receiving food waste and water. The inlet 107 may be surrounded by a gasket 111. The inlet housing 108 can be attached to the conveying housing 110 by an anti-vibration mount 113, for example.

The conveying housing 110 may include an opening 142 to receive a dishwasher inlet 144. The dishwasher inlet 144 is used to pass water and food waste from a dishwasher (not shown) to the disposer 100. The inlet housing 108 and conveying housing 110 may be made of metal or plastic, for example. In some embodiments, the inlet housing 108 and conveying housing 110 may be one unitary piece.

The central grinding section 104 may include a grinding mechanism 114 having a shredder plate assembly 116 and a stationary grind ring 118. The housing 112 is formed as a clamp ring and clamps conveying housing 110 to an upper end bell 136 of motor section 106. The stationary grind ring 118, which includes a plurality of spaced teeth 120 (only two of which are indicated by reference number 120 in FIG. 1), may be received in an adaptor ring 122 disposed between the housing 112 and the stationary grind ring 118. A gasket 123 is disposed between the adaptor ring 122 and an upper portion 125 of the housing 112. A bottom flange 127 of the conveying housing 110 is received in the gasket 123 and the gasket 123 seals the conveying housing 110 to the adaptor ring 122.

The shredder plate assembly 116 may include a rotating shredder plate 124 mounted to a rotatable shaft 126 of a motor 128 of the motor section 106, such as by a bolt 130. The motor 128 also includes a rotor 129 to which the rotatable shaft 126 is affixed and a stator 131. A plurality of fixed lugs 132 (only one of which is shown in FIG. 1) are mounted on the rotating shredder plate 124 as are a plurality of swivel lugs 134 (only one of which is shown in FIG. 1). It should be understood that in this regard, the rotating shredder plate assembly 116 could include only the fixed lugs 132 or only the swivel lugs 134.

The motor section 106 includes an upper end bell 136 affixed to a bottom 138 of the grinding section 104. The upper end bell 136 includes a discharge chamber 140 having a discharge outlet 141 for coupling to a tailpipe or drainpipe (not shown).

In an aspect, the food waste disposer 100 may include a trim shell 146 that surrounds the food conveying section 102, the grinding section 104 and the motor section 106. A layer of sound insulation 148 may be disposed between the trim shell 146 and the conveying housing 110 of the food conveying section 102 and the housing 112 of the grinding section 104.

In the operation of the food waste disposer 100, the food waste delivered by the food conveying section 102 to the grinding section 104 is forced by the lugs 132, 134 of the rotating shredder plate assembly 116 against the teeth 120 of the stationary grind ring 118. The sharp edges of the teeth 120 grind or comminute the food waste into particulate matter that combines with water, such as water that entered the food waste disposer through inlet 107, to form a slurry that drops into the discharge chamber 140. This slurry is then discharged through the discharge outlet (not shown) into the tailpipe or drainpipe (not shown).

Figure 2:
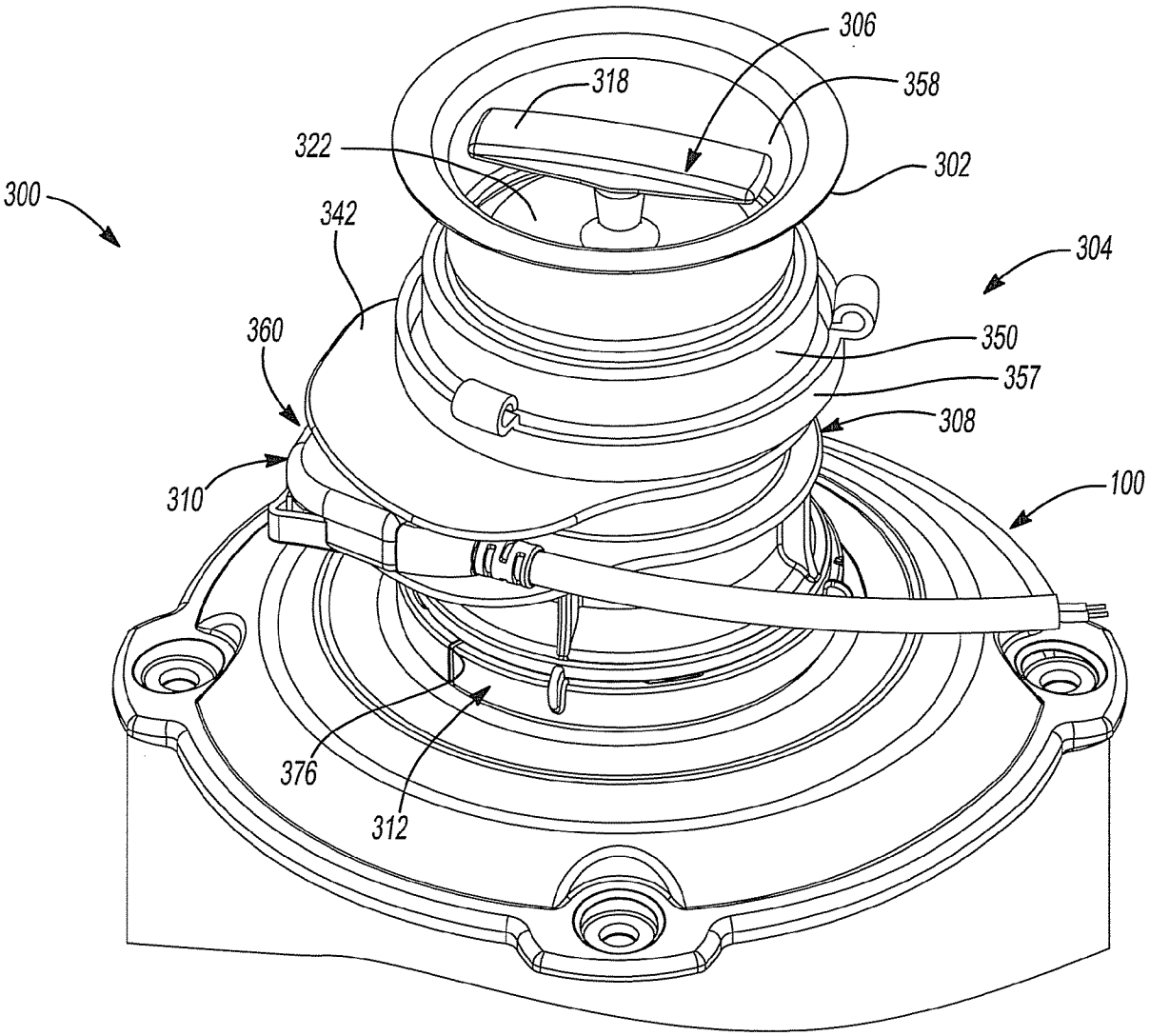
FIG. 2 is a partial perspective view of a food waste disposer system including the disposer unit of FIG. 1 and a batch-feed switch assembly mounted to the disposer unit according to the principles of the present disclosure.

Referring now to FIG. 2, a food waste disposer system 300 is provided that may include the disposer 100 and a batch-feed switch assembly 304, it being understood that disposer 100 has the modifications discussed below. The food waste disposer system 300 mounts to a sink flange 302 that may be disposed in a drain opening of a sink (not shown). The batch-feed switch assembly 304 may be coupled to the disposer 100 and the sink flange 302 to fluidly couple the sink and the disposer 100.

Figure 3:
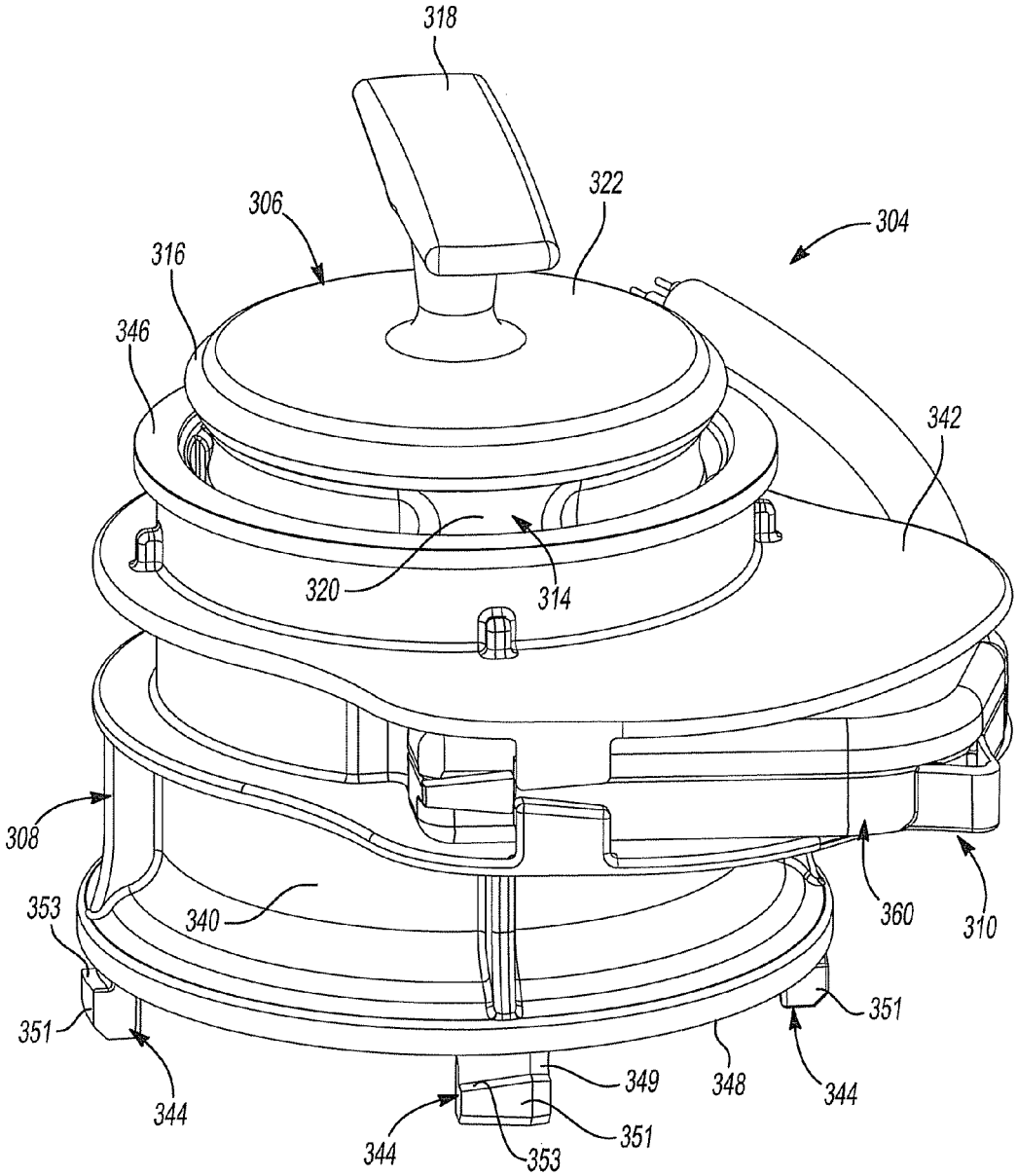
FIG. 3 is a perspective view of the batch-feed switch assembly according to the principles of the present disclosure.
Figure 4:
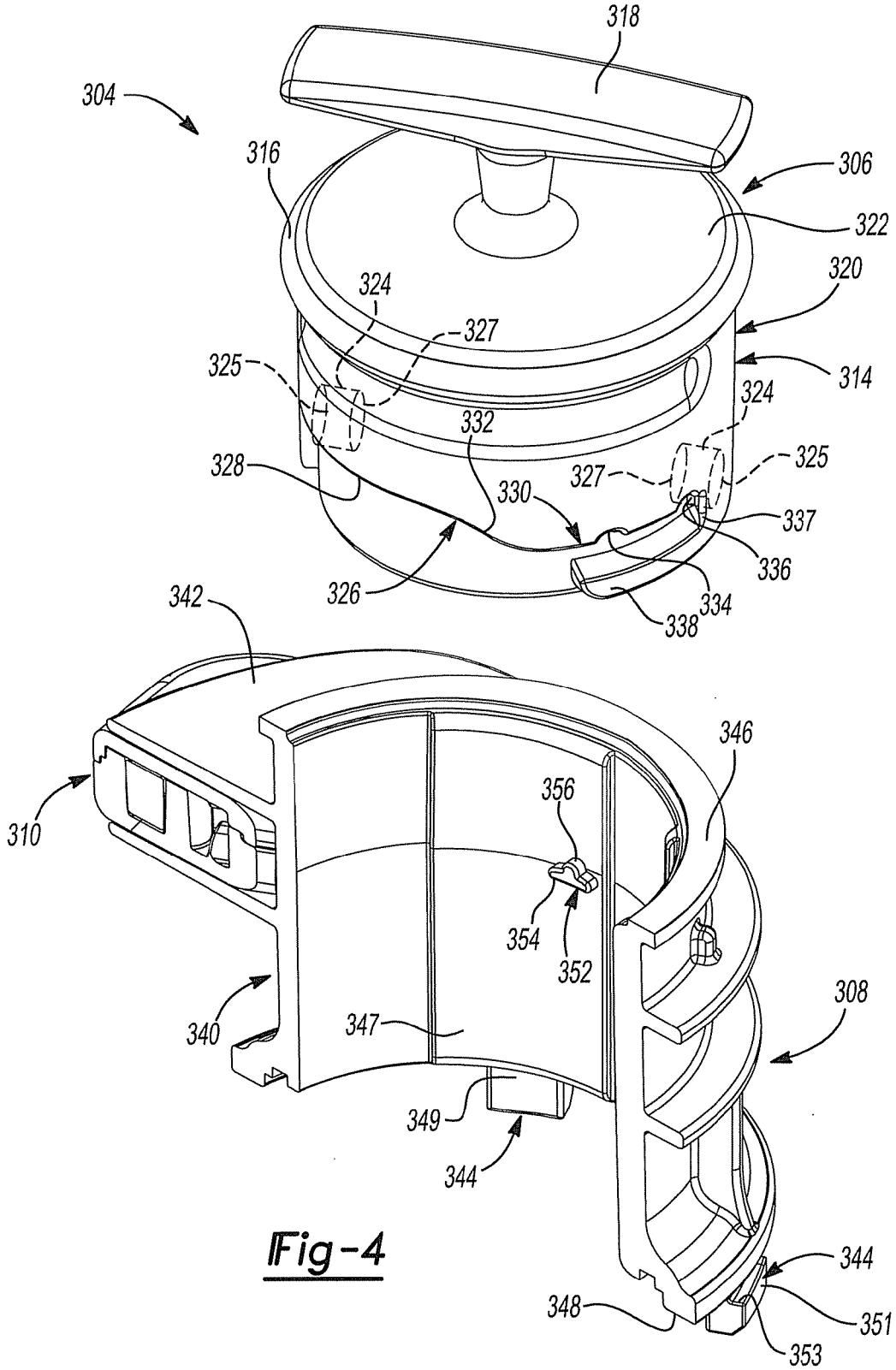
FIG. 4 is a partially cross-sectioned exploded perspective view of a stopper and extension tube of the batch-feed switch assembly.
Figure 5:
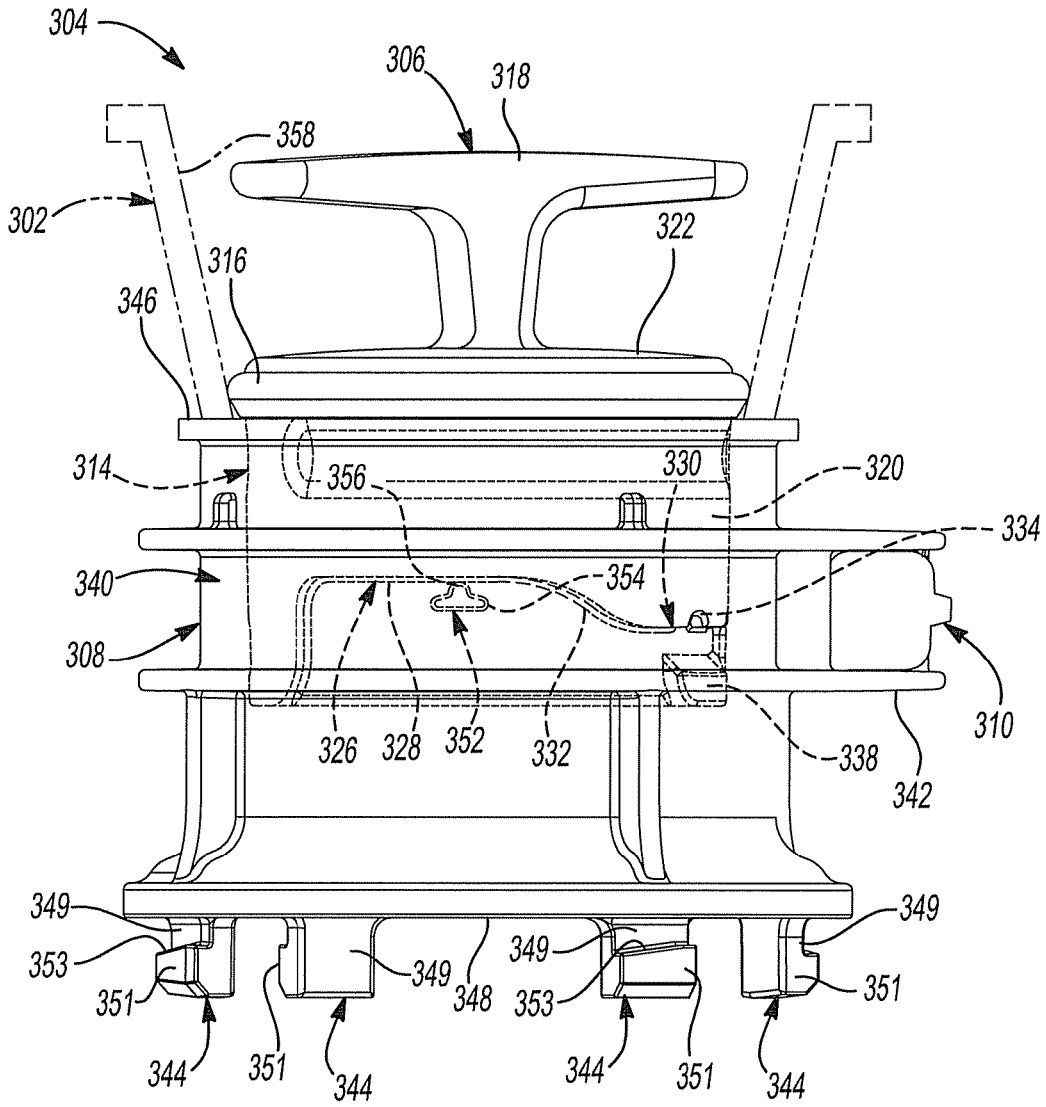
FIG. 5 is a side view of the stopper and extension tube with the stopper in a sealed position according to the principles of the present disclosure.

With reference to FIGS. 2-8, the batch-feed switch assembly 304 may include an activation member, which may be stopper 306, an extension tube 308, a switch unit 310 and a lock ring 312 (shown in FIG. 2). As shown in FIGS. 3-5, the stopper 306 may include a generally hollow cylindrical body 314, a seal 316, and a handle 318. The body 314 can be molded, cast, machined or otherwise formed from a polymeric or metallic material, for example, and may include an outer circumferential portion 320 and a cap portion 322. The cap portion 322 can be integrally formed with the circumferential portion 320 or may be secured thereto by one or more fasteners or a press or snap fit, for example. The seal 316 may be a polymeric or elastomeric member, for example, and may sealingly engage the body 314. The handle 318 may be integrally formed with the cap portion 322 or secured thereto by a snap or press fit or by a screw or other fastener, for example.

One or more first magnets 324 (FIG. 4) may be imbedded into or received in the circumferential portion 320 of the stopper 306 (via adhesive bonding and/or a press or snap-fit, for example). In the particular embodiment shown in the figures, the stopper 306 includes two first magnets 324 angularly spaced apart from each other by one-hundred-eighty degrees. The first magnets 324 may be oriented relative to the circumferential portion 320 such that ends 325 of the first magnets 324 having a first polarity are facing radially outward and ends 327 of the first magnets 324 having a second opposite polarity face radially inward.

As shown in FIGS. 4-8, the outer circumferential portion 320 may include a track 326 formed therein. The track 326 may include a pair of upper portions 328, a pair of lower portions 330 (only one of which is shown in FIGS. 4-8). The lower portions 330 may be disposed one-hundred-eighty degrees apart and between the upper portions 328. The lower portions 330 may be disposed axially further from the cap portion 322 than the upper portions 328. Each upper portion 328 is connected to a corresponding one of the lower portions 330 by a ramp portion 332. Each lower portion 330 may include a first detent 334 and a second detent 336. The first detent 334 of each lower portion 330 may be disposed between the corresponding second detent 336 and ramp portion 332. The lower portions 330 may also include a stop wall 337 disposed adjacent the corresponding second detent 336. The track 326 may also include a pair of diverters 338, each of which may be disposed axially beneath a corresponding one of the lower portions 330.

The extension tube 308 may include a generally tubular body 340, a flange 342, and a plurality of feet 344. The flange 342 may extend radially outward from the body 340 and may engage the switch unit 310 via a snap fit and/or any suitable fastening means. The body 340 may include an upper open end 346 (as oriented when extension tube 308 is attached to the sink as discussed below), a lower open end 348 and an inner circumferential portion 347 (shown in FIG. 4). The plurality of feet 344 may extend axially from the lower end 348 and may include stems 349 and barbed portions 351 that extend radially outward from the stems 349. Each of the barbed portions 351 may include an inclined surface 353.

The inner circumferential portion 347 of the extension tube 308 may include a pair of protrusions 352 extending radially inward therefrom. As shown in FIG. 4, each protrusion 352 may include a body 354 and a lobe 356 extending axially upward from the body 354. The protrusions 352 may be spaced one-hundred-eighty degrees apart from each other. In some embodiments, the extension tube 308 may include only a single protrusion 352.

The extension tube 308 may be attached to the sink using a mounting assembly such as the type described in U.S. Pat. No. 3,025,007, for example, or any other suitable mounting assembly. The mounting assembly can include a sink flange assembly, a mounting gasket 350 (FIG. 2) and a lower mounting flange 357 (FIG. 2). The sink flange assembly may include the sink flange 302 (FIG. 2), a sink gasket (not shown), a back-up flange (not shown), an upper mounting flange (not shown), bolts (not shown) and a retaining ring (not shown). As shown in FIG. 2, the mounting gasket 350 is placed over the upper open end 346 of the extension tube 308 with the lower mounting flange 357 of the mounting assembly disposed below mounting gasket 350. The lower mounting flange 357 is then moved up to engage the upper mounting flange and removably secured to the upper mounting flange. The mounting gasket 350 is compressed between the upper open end 346 of extension tube 308 and a lower end of the sink flange. If the disposer 100 were installed as a continuous-feed disposer, the mounting gasket 350 is placed around inlet housing 108 (illustratively around an upper edge thereof) of the disposer 100 and could be mounting directly to the lower mounting flange 357. Therefore, the batch-feed switch assembly 304 can be retrofitted to a pre-existing continuous-feed disposer by placing the mounting gasket 350 over the upper end 346 of the extension tube 308 with the lower mounting flange 357 disposed beneath it and attaching the lower end 348 of the extension tube 308 to the inlet housing 108 of the disposer 100 via the lock ring 312, as shown in FIG. 2.

Figure 7:
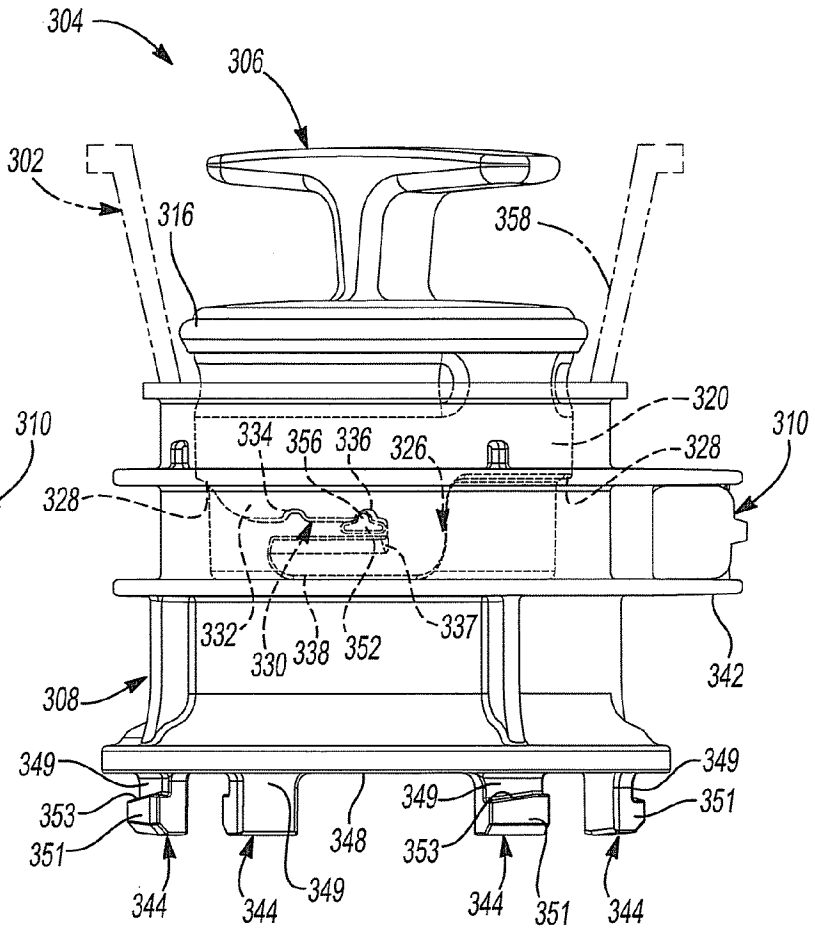
FIG. 7 is a side view of the stopper and extension tube with the stopper in a run position according to the principles of the present disclosure.
Figure 6:
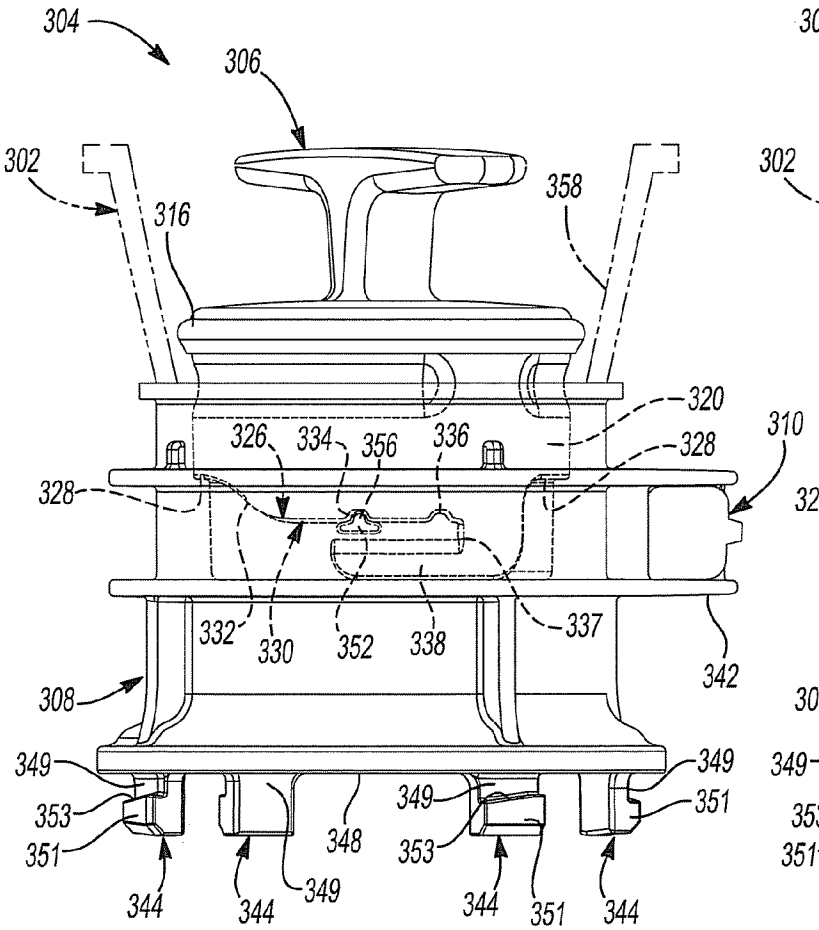
FIG. 6 is a side view of the stopper and extension tube with the stopper in a park position according to the principles of the present disclosure.
Figure 8:
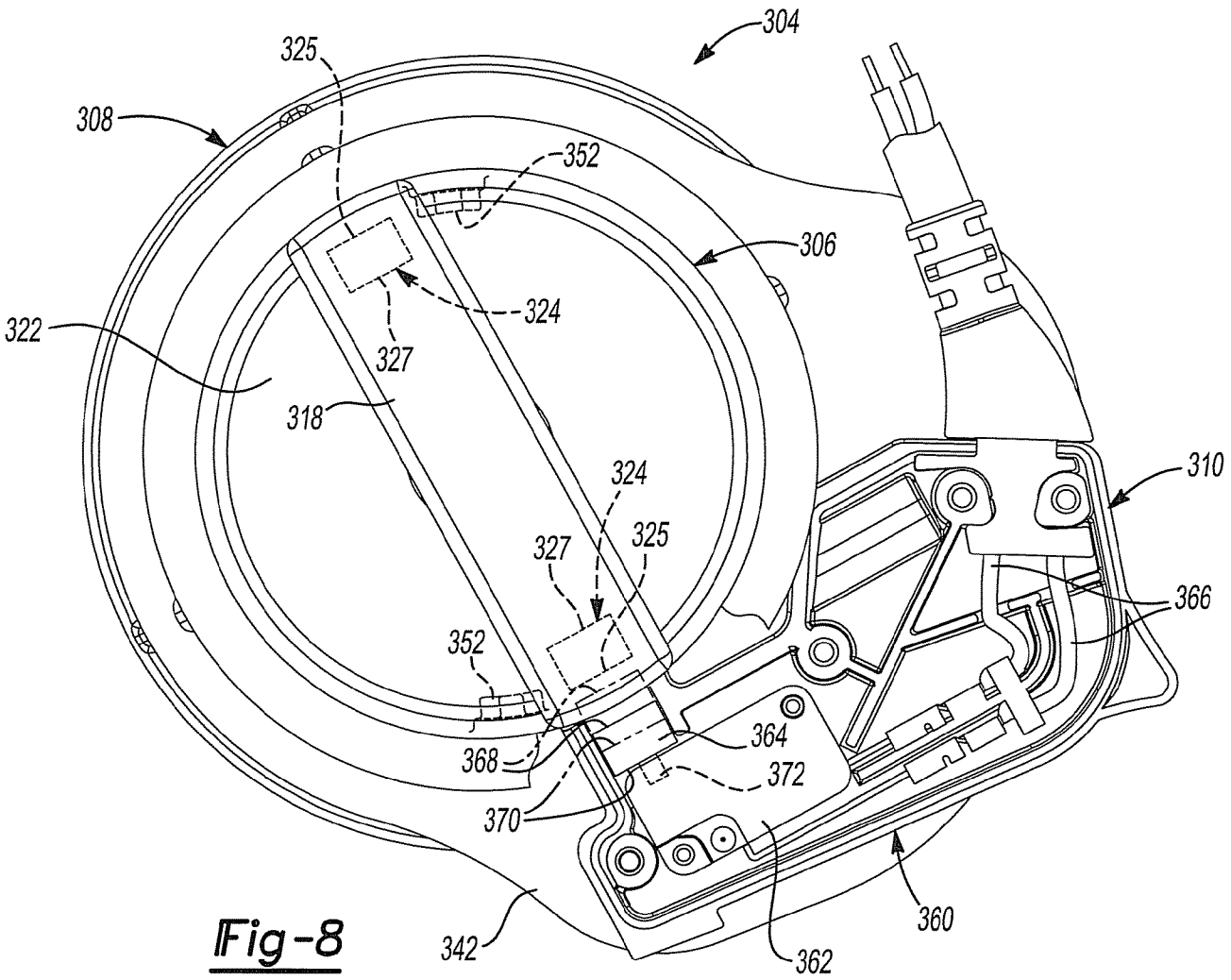
FIG. 8 is a partially cutaway overhead view of the stopper, the extension tube and a switch unit with the stopper in the run position according to the principles of the present disclosure.

As shown in FIGS. 5-7, the stopper 306 may be received in the extension tube 308 such that the protrusions 352 engage the track 326 of the stopper 306. As will be subsequently described, the stopper 306 is selectively positionable relative to the extension tube 308 among a seal position (FIG. 5), a park position (FIG. 6) and a run position (FIGS. 7 and 8). In the seal position, the protrusions 352 may slidably engage a corresponding one of the upper portions 328 of the track 326. In the park position, the lobe 356 of each protrusion 352 may engage a corresponding first detent 334. In the run position, the lobe 356 of each protrusion 352 may engage a corresponding second detent 336. As shown in FIG. 5, when the stopper 306 is in the seal position, the seal 316 of the stopper may sealingly engage an inner surface 358 of the sink flange 302 or an inner diameter of the mounting gasket 350, thereby preventing fluid from flowing through the extension tube 308 from the drain. As shown in FIGS. 6 and 7, when the stopper 306 is in either of the park or run positions (as well as when the protrusions 352 are engaged with any part of the lower portion 330 or ramp portion 332 of the track 326), the seal 316 is spaced apart from the inner surface 358 of the sink flange 302, thereby allowing fluid to flow from the drain, through the extension tube 308 and into the disposer 100.

As shown in FIG. 8, the switch unit 310 may include a switch housing 360, a switching mechanism 362, a second magnet 364, and a plurality of wires 366. The switch housing 360 may contain and surround the switching mechanism 362, second magnet 364 and at least portions of the wires 366. The switching mechanism 362 (shown schematically in FIG. 8) and wires 366 are in electrical communication with the motor 180 of the disposer 100 and a source of electrical current (e.g., an electrical system of a house or building in which the sink and food waste disposer system 300 are installed). The switching mechanism 362 may be operable in a first state to prevent communication between the motor 180 and the source of electrical current and a second state allowing communication between the motor 180 and the source of electrical current.

The second magnet 364 may be slidable within the switch housing 360 toward and away from the stopper 306 and the inner circumferential portion 347 of the extension tube 308 between an off-position (shown in solid lines in FIG. 8) and an on-position (shown in phantom lines in FIG. 8). The second magnet 364 may include first and second ends 368, 370 having opposite polarity. The first end 368 may be disposed closer to the stopper 306 and the inner circumferential portion 347 and may have a polarity that is the same as the polarity of the first ends 325 of the first magnets 324 in the stopper 306.

Therefore, when the first end 325 of either of the first magnets 324 is moved into sufficiently close proximity to the first end 368, a repulsive magnetic force is generated that causes the second magnet 364 to move relative to the switch housing 360 from the off-position to the on-position. When the first magnets 324 are sufficiently spaced apart from the second magnet 364, a spring 372 forces the second magnet 364 back to the off-position. The first magnets 324 are positioned in the stopper 306 and the second magnet 364 is positioned relative to the protrusions 352 of the extension tube 308 such that when the stopper 306 is in the run position (FIG. 7) relative to the extension tube 308, the first magnets 324 are substantially angularly aligned with the second magnet 364 (as shown in FIG. 8) and one of the first magnets 324 is in close enough proximity to the second magnet 364 to generate the repulsive magnetic force that moves the second magnet 364 into the on-position. Moving the stopper 306 into the park position (FIG. 6) or the seal position (FIG. 5) will move the first magnets 324 far enough away from the second magnet 364 to allow the spring 372 to overcome any remaining magnetic force acting on the second magnet 364 and move the second magnet to the off-position.

Figure 9:
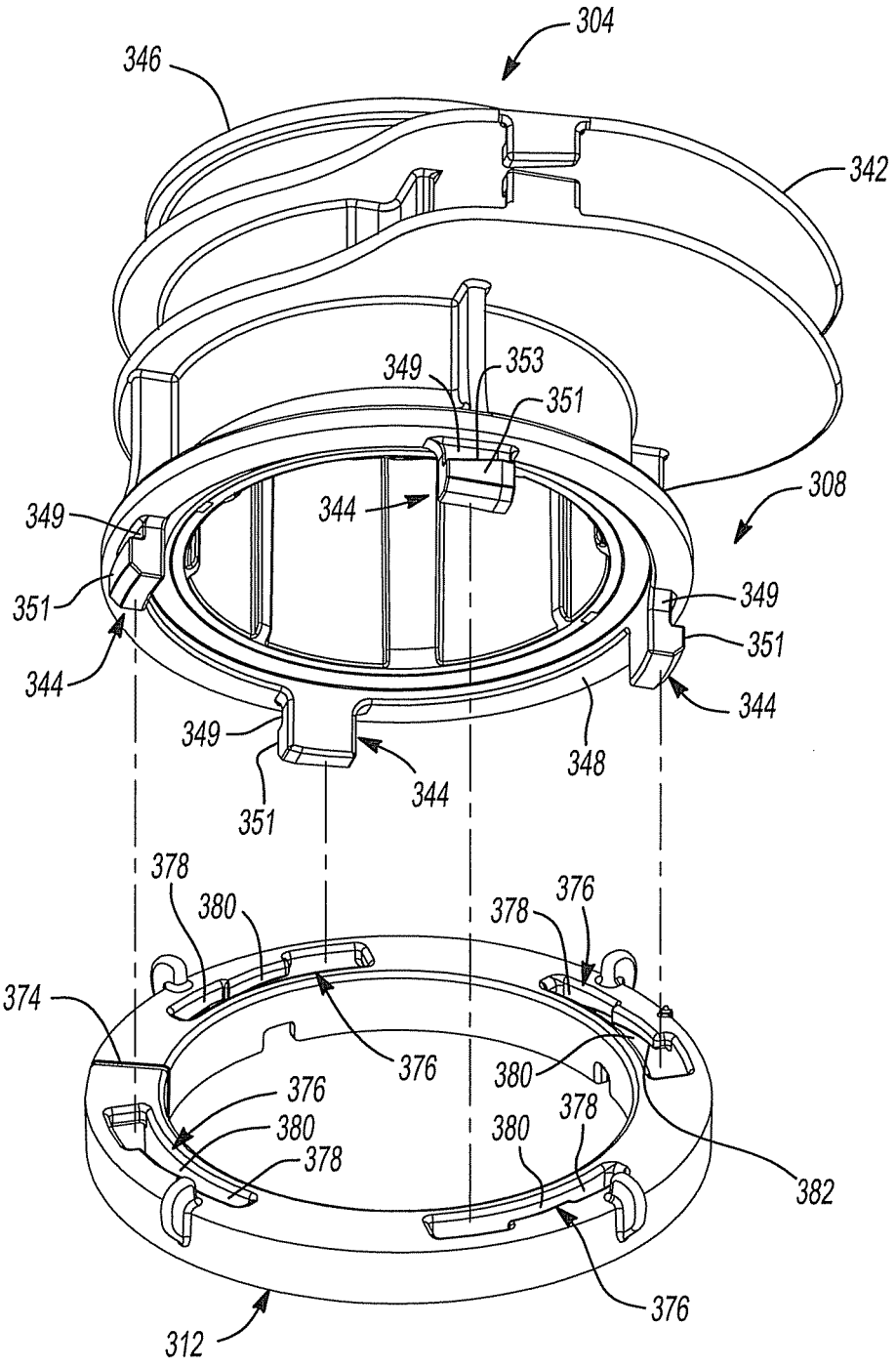
FIG. 9 is an exploded perspective view of the extension tube and a lock ring according to the principles of the present disclosure.
Figure 10:
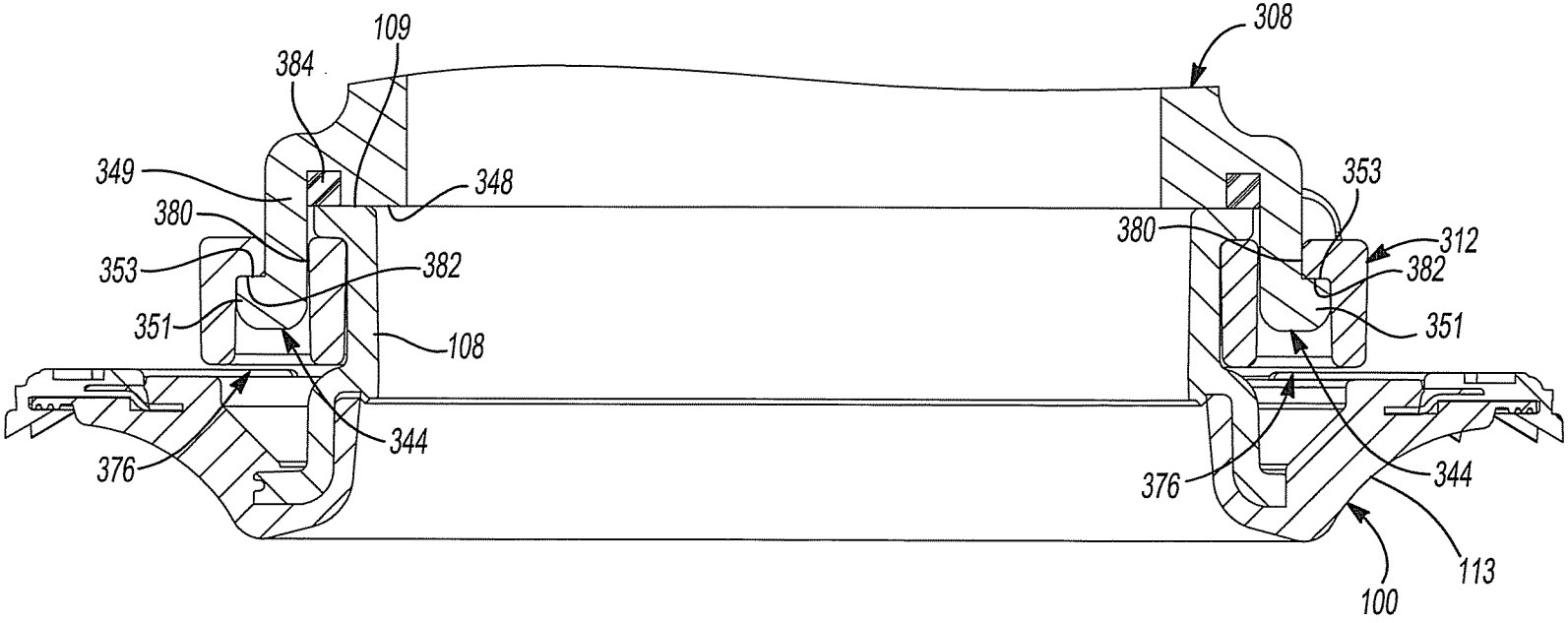
FIG. 10 is a partial cross-sectional view of the extension tube secured to an inlet of the disposer unit by the lock ring according to the principles of the present disclosure.

As shown in FIGS. 9 and 10, the lock ring 312 may be a generally annular member having a slit 374 and a plurality of slots 376. The lock ring 312 may be formed from a semi-rigid polymeric or metallic material, for example. The slit 374 may extend through the lock ring 312 and may allow the lock ring 312 to be resiliently stretched open (i.e., stretched to temporarily expand a diameter of the lock ring 312). In this manner, the lock ring 312 can be stretched to be snap fitted onto the inlet housing 108 of the disposer 100. That is, the lock ring 312 can be stretched to snap over a radially extending flange 109 of the inlet housing 108, as shown in FIG. 10.

Each of the slots 376 may define a cavity having an insertion opening 378 and a channeled portion 380. The insertion opening 378 may be sized to allow the barbed portion 351 of the feet 344 of the extension tube 308 to be inserted therethrough into the slots 376. The channeled portion 380 may be sized such that the stem 349 of the feet 344 can extend therethrough, while the barbed portion 351 of the feet 344 cannot be inserted or removed therethrough. The channeled portion 380 may have an inclined surface 382 that slidably engages the inclined surfaces 353 of the feet 344.

When connecting the lock ring 312 to the extension tube 308, the feet 344 of the extension tube 308 can be inserted into the insertion openings 378 of the slots 376. Once the barbed portions 351 of the feet 344 are received within the slots 376, the lock ring 312 may be rotated relative to the extension tube 308 such that the inclined surfaces 382 of the lock ring 312 slide along the inclined surfaces 353 of the feet 344. In this manner, the inclined surfaces 353, 382 cooperate to act as a threaded connection and create an axial compression force that biases the lower end 348 of the extension tube 308 into sealing engagement with the flange 109 of the inlet housing 108. A sealing member 384 may engage the lower end 348 and the flange 109 to facilitate a sealed relationship therebetween.

With particular reference to FIGS. 1, 2 and 5-8, operation of the batch-feed switch assembly 304 will be described in detail. The batch-feed switch assembly 304 may be operable to selectively activate the motor 180 of the disposer 100 to grind a discrete batch of food and/or other objects and subsequently deactivate the motor 180 before another batch of food and/or objects can be inserted into the disposer 100 to be ground.

For example, with the stopper 306 removed from the extension tube 308, a user may place a quantity of food and/or other waste down the drain of the sink (i.e., through the sink flange 302), through the extension tube 308 and into the grinding section 104 of the disposer 100. The stopper 306 may then be inserted into the extension tube 308 such that the track 326 on the stopper 306 slidably engages the protrusion 352 on the extension tube 308. The stopper 306 may then be moved relative to the extension tube 308 into the run position (i.e., the position shown in FIGS. 7 and 8 in which the protrusion(s) 352 is(are) engaged with the second detent(s) 336 of the track 326). Moving the stopper 306 into the run position activates the motor 180, which causes the disposer 100 to grind the batch of food that the user had placed therein prior to inserting the stopper 306 into the extension tube 308. As described above, when the stopper 306 is in the run position, the seal 316 on the stopper 306 is spaced apart from the inner surface 358 of the sink flange 302 (as shown in FIG. 7). This allows water from a faucet of the sink to continue to flow down the drain of the sink and into the disposer 100 while the disposer 100 is operating so that a constant flow of water can flush the ground food and/or waste out of the disposer 100 through the discharge outlet 162.

After grinding the food and/or waste, the user may rotate the stopper 306 to the park position (i.e., the position shown in FIG. 6 in which the protrusion(s) 352 is(are) engaged with the first detent(s) 334 of the track 326), which separates the first magnets 324 from the second magnet 364 so that the spring 372 can force the second magnet 364 to the off-position. As described above, this causes the switch unit 310 to prevent electrical current from reaching the motor 180, thereby deactivating the disposer 100. In the park position, the seal 316 is spaced apart from the inner surface 358 of the sink flange 302 to allow water to drain from the sink, through the extension tube 308 and into the disposer 100.

From the park position, the user can either return the stopper 306 to the run position or rotate the stopper 306 in the opposite direction toward the seal position (i.e., the position shown in FIG. 5 in which the protrusion(s) 352 is(are) engaged with the upper portions 328 of the track 326). Once the stopper 306 is rotated to a position in which the protrusion(s) 352 is(are) engaged with or adjacent to the ramp portion(s) 332 of the track 326, the protrusion(s) 352 may be angularly spaced apart from the diverter(s) 338, which allows the user to lift the stopper 306 axially out of the extension tube 308 to remove the stopper 306 from the drain opening. If the stopper 306 is positioned relative to the extension tube 308 in any position such that the protrusion(s) 352 is(are) between or engaged with either of the first and second detents 334, 336, the diverter(s) 338 may prevent the stopper 306 from being lifted axially out of the extension tube 308.

With the stopper 306 removed from the extension tube 308, the user may insert additional food waste through the extension tube 308 and into the disposer to be ground once the stopper 306 is replaced in the extension tube 308 and moved into the run position, as described above.

As described above, when the stopper 306 is moved into the seal position (FIG. 5), the seal 316 of the stopper 306 may sealingly engage the inner surface 358 of the sink flange 302 to prevent water from flowing through the sink flange 302 and into the extension tube 308. Therefore, with the stopper 306 in the seal position, the user may continue to run water out of the faucet to fill up the basin of the sink to soak or wash dishes therein, for example.

Figure 11:
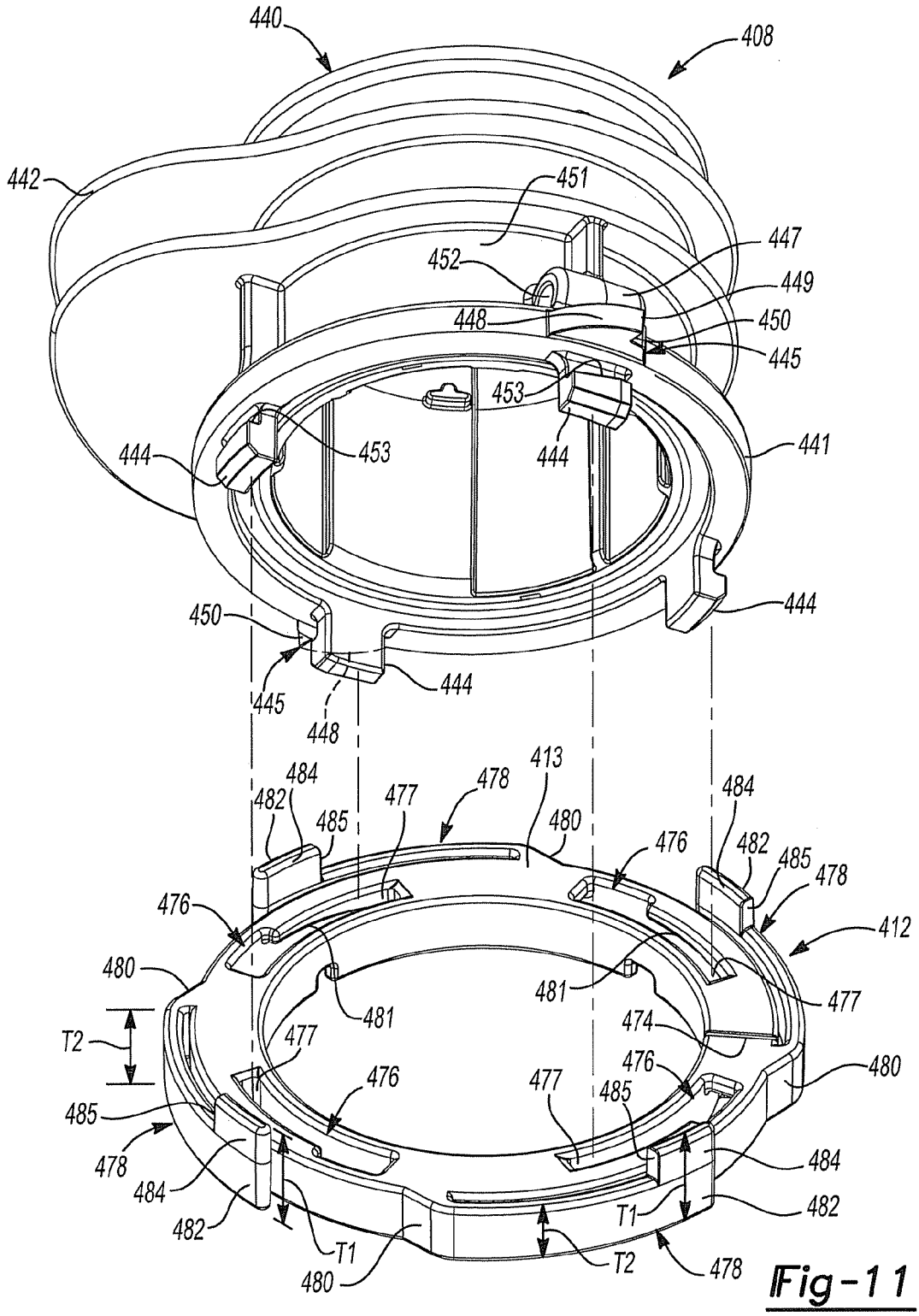
FIG. 11 is an exploded perspective view of another extension tube and another lock ring according to the principles of the present disclosure.
Figure 12:
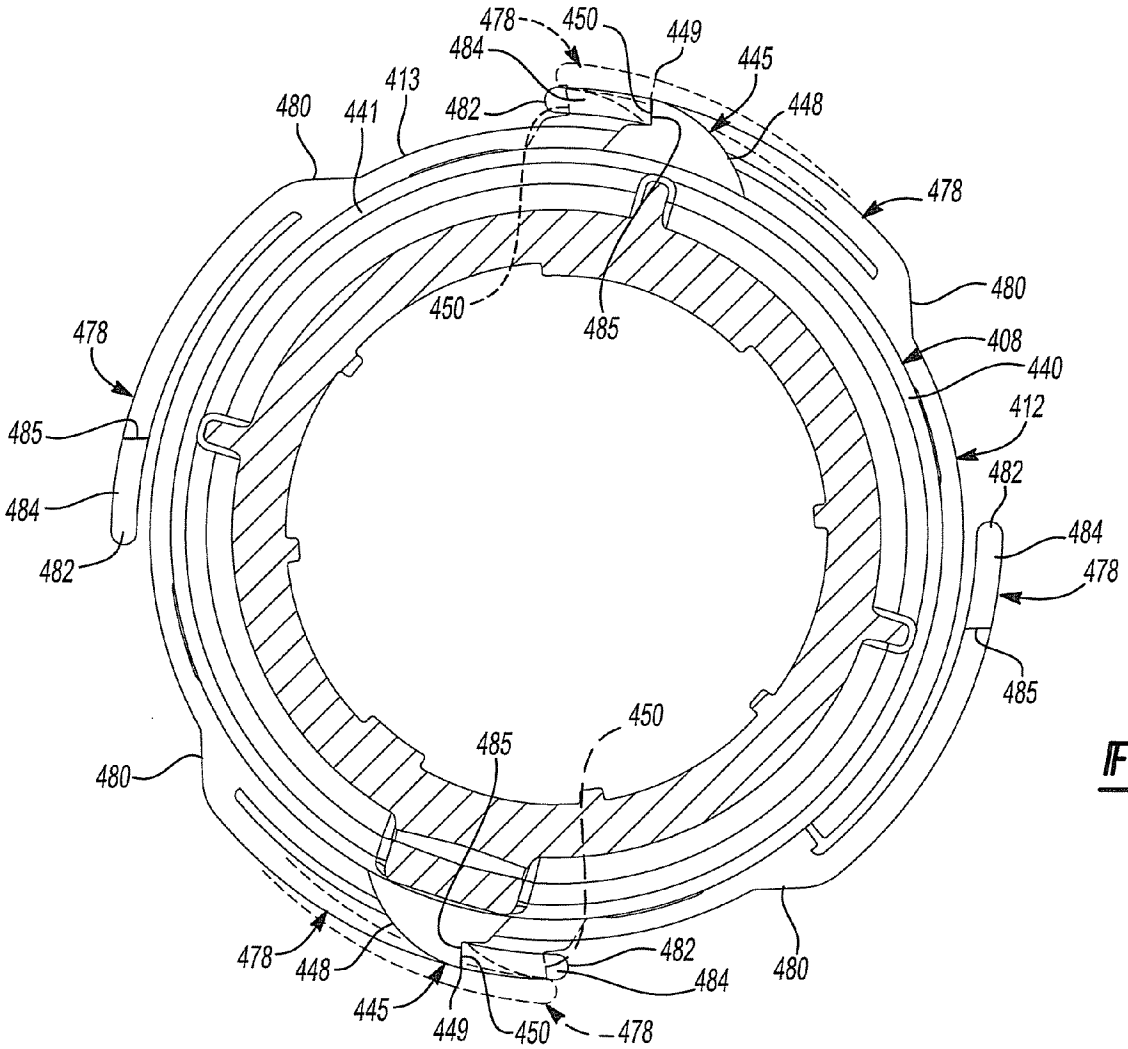
FIG. 12 is a cross-sectional view of the extension tube and lock ring of FIG. 11 engaged with each other according to the principles of the present disclosure.

With reference to FIGS. 11 and 12, another extension tube 408 and another lock ring 412 are provided. The extension tube 408 and lock ring 412 can be incorporated into the batch-feed switch assembly 304 described above in place of the extension tube 308 and lock ring 312. The structure and function of the extension tube 408 and lock ring 412 may be substantially similar to that of the extension tube 308 and lock ring 312 described above, apart from any exceptions described below and/or shown in the figures.

The extension tube 408 may include a generally tubular body 440, a flange 442, a plurality of feet 444 having inclined surfaces 453, a plurality of teeth 445, and a tool-engagement feature 447. The structure and function of the body 440, flange 442 and feet 444 may be substantially similar to that of the body 340, flange 342 and feet 344, respectively, and therefore, will not be described again in detail. The teeth 445 may be protrusions that extend radially outward from a lower rim 441 of the body 440 from which the feet 444 extend. The teeth 445 may include a ramped surface 448 and an engagement surface 450. While FIGS. 11 and 12 depict the extension tube 408 having two teeth 445 spaced approximately one hundred eighty degrees apart, it will be appreciated that the extension tube 408 could have only a single tooth 445 or four evenly spaced teeth 445, for example, or any other number and arrangement of teeth 445.

As shown in FIG. 11, the tool-engagement feature 447 can be a generally tubular member that may extend outward from the body 440 and may be generally tangential to a surface 451 of the body 440. A hole 452 may extend at least partially through the tool-engagement feature 447 and may be sized and shaped to receive a shaft of a wrench (not shown) or any other tool or lever. A user may insert the shaft of the wrench or other tool into the hole 452 to provide leverage for the user to apply a torque to the extension tube 408 during assembly of the batch-feed switch assembly 304 and/or installation of the batch-feed switch assembly 304 into the food waste disposer system 300.

The lock ring 412 may be a generally annular member and may include a slit 474, a plurality of slots 476 and a plurality of resiliently flexible locking arms 478. The slit 474 and slots 476 may be substantially similar to that of the slit 374 and slots 376 described above, and therefore, will not be described again in detail. The locking arms 478 may extend from a body 413 of the lock ring 412 and may be generally concentric with the body 413. The locking arms 478 may include a proximal end 480 and a distal end 482. The proximal end 480 may be attached to or integrally formed with the body 413. The distal end 482 may include a locking tab 484 that includes a thickness T1 (shown in FIG. 11) that is greater than a thickness T2 (shown in FIG. 11) of the proximal end 480 and body 413.

It will be appreciated that in some embodiments, the lock ring 412 could be formed such that the body 413 may be only a semi-annular body. That is, the body 413 may only extend between approximately one hundred eighty and approximately two hundred seventy degrees, for example, rather than nearly three hundred sixty degrees, as shown in FIGS. 11 and 12. In such embodiments, the lock ring 412 may include only a pair of locking arms 478 and slots 476. In other embodiments, the lock ring 412 could include two separate semi-annular bodies (each having a pair of locking arms 478 and slots 476) that may cooperate with each other to extend approximately three hundred sixty degrees around the extension tube 408.

The lock ring 412 can be connected to the extension tube 408 by inserting the feet 444 of the extension tube 408 into the slots 476 of the lock ring 412 in a similar manner as described above with reference to the lock ring 312 and extension tube 308. The extension tube 408 and lock ring 412 may be secured together by rotating the lock ring 412 relative to the extension tube 408 such that inclined surfaces 481 (shown in FIG. 11) of the lock ring 412 slide along the inclined surfaces 453 (shown in FIG. 11) of the feet 444 in the manner described above with reference to the lock ring 312 and extension tube 308. As the feet 444 slide toward narrow ends 477 (shown in FIG. 11) of the slots 476, the locking tabs 484 of the locking arms 478 will come into contact with and slide along the ramped surfaces 448 of the teeth 445. As the locking tabs 484 slide along the ramped surfaces 448 toward the engagement surfaces 450, the locking arms 478 will flex outward (as shown in phantom lines in FIG. 12) until the locking tabs 484 are slid off of the ends 449 of the ramped surfaces 448. When the locking tabs 484 are slid off of the ends 449 of the ramped surfaces 448, the locking arms 478 may snap back inward so that engagement surfaces 485 of the locking tabs 484 abut the engagement surfaces 450 of the teeth 445 (shown in solid lines in FIG. 12). In this manner, the locking tabs 484 and the teeth 445 cooperate to prevent the lock ring 412 and extension tube 408 from being inadvertently disassembled from each other.

Figure 13:
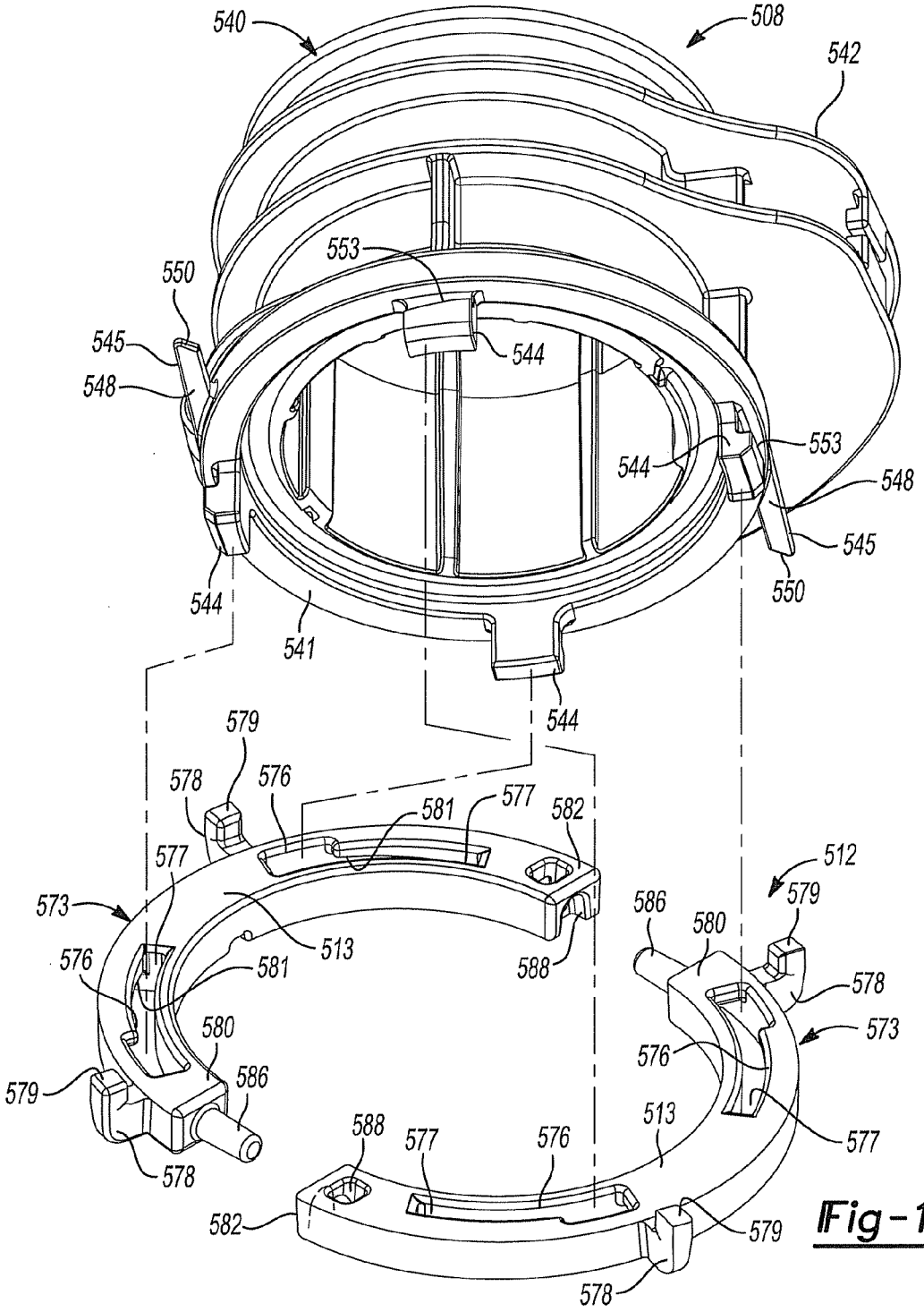
FIG. 13 is an exploded perspective view of yet another extension tube and yet another lock ring according to the principles of the present disclosure.
Figure 14:
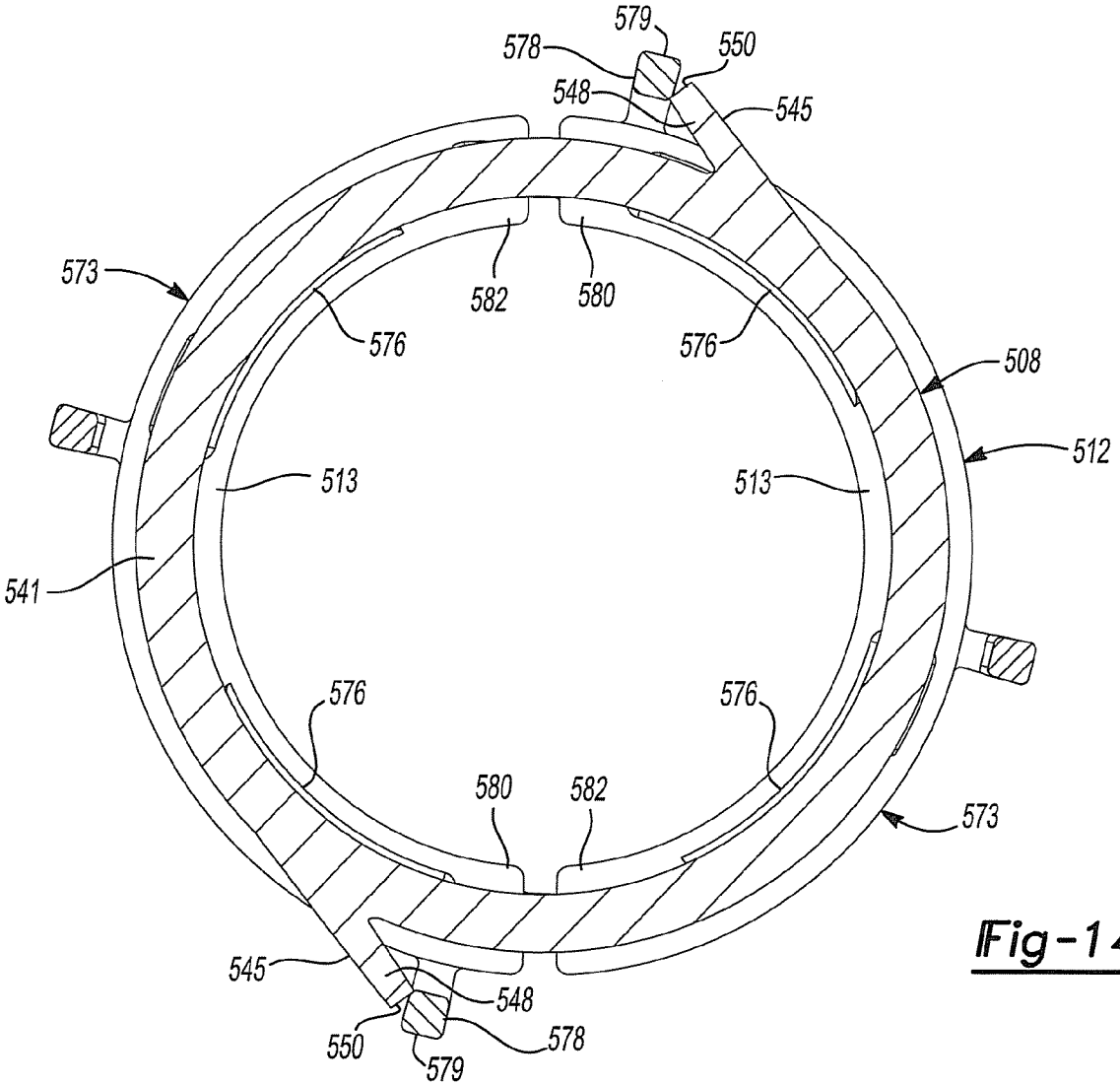
FIG. 14 is a cross-sectional view of the extension tube and lock ring of FIG. 13 engaged with each other according to the principles of the present disclosure.

With reference to FIGS. 13 and 14, another extension tube 508 and another lock ring 512 are provided. The extension tube 508 and lock ring 512 can be incorporated into the batch-feed switch assembly 304 described above in place of the extension tube 308 and lock ring 312. The structure and function of the extension tube 508 and lock ring 512 may be substantially similar to that of the extension tubes 308, 408 and lock rings 312, 412 described above, apart from any exceptions described below and/or shown in the figures.

The extension tube 508 may include a generally tubular body 540, a flange 542, a plurality of feet 544 having inclined surfaces 553, and a plurality of tabs 545. The structure and function of the body 540, flange 542 and feet 544 may be substantially similar to that of the body 340, 440, flange 342, 442 and feet 344, 444, respectively, and therefore, will not be described again in detail. The tabs 545 may be protrusions that extend radially outward from a lower rim 541 of the body 540 from which the feet 544 extend. The tabs 545 may include a flexible body 548 having an end 550. While FIGS. 13 and 14 depict the extension tube 508 having two tabs 545 spaced approximately one hundred eighty degrees apart, it will be appreciated that the extension tube 508 could have only a single tab 545 or four evenly spaced tabs 545, for example, or any other number and arrangement of tabs 545.

The lock ring 512 may be a generally annular body formed from two identical semi-annular ring portions 573. The ring portions 573 may be cast, molded and/or machined from a metallic or polymeric material, for example. Each of the ring portions 573 may include a plurality of slots 576 and a plurality of locking arms 578. The slots 576 may be substantially similar to that of the slots 376, 476 described above, and therefore, will not be described again in detail. The locking arms 578 may be generally L-shaped members extending from a body 513 of a corresponding one of the ring portions 573. When the lock ring 512 and extension tube 508 are installed onto the disposer 100, distal ends 579 of the locking arms 578 may extend upward toward the tabs 545 of the extension tube 508.

Each of the ring portions 573 may include a first end 580 and a second end 582. The first end 580 may include a peg 586 and the second end 582 may include an aperture or slot 588. To install the lock ring 512 onto the disposer 100, the two ring portions 573 may be placed around the inlet housing 108 (shown in FIGS. 1 and 10) and moved together underneath the flange 109 of the inlet housing 108 such that the peg 586 of each ring portion 573 is received in the aperture or slot 588 of the other ring portion 573.

The lock ring 512 can be connected to the extension tube 508 by inserting the feet 544 of the extension tube 508 into the slots 576 of the lock ring 512 in a similar manner as described above with reference to the lock ring 312 and extension tube 308. The extension tube 508 and lock ring 512 may be secured together by rotating the lock ring 512 relative to the extension tube 508 such that inclined surfaces 581 (shown in FIG. 13) of the lock ring 512 slide along the inclined surfaces 553 of the feet 544 in the manner described above with reference to the lock ring 312 and extension tube 308. As the feet 544 slide toward narrow ends 577 (shown in FIG. 13) of the slots 576, the tabs 545 may be flexed upward to provide clearance for the locking arms 578 to pass underneath the tabs 545. Once the extension tube 508 has been rotated to the position shown in FIG. 14, where the tabs 545 are clear of the locking arms 578, the tabs 545 can be released so that the ends 550 of the tabs 545 can return to the same plane as the distal ends 579 of the locking arms 578, as shown in FIG. 14. In the position shown in FIG. 14, interference between the locking arms 578 and the tabs 545 may prevent the lock ring 512 and extension tube 508 from being inadvertently disassembled from each other. Furthermore, when the extension tube 508 is secured onto the ring portions 573 of the lock ring 512, the ring portions 573 are prevented from disengaging each other.

While the batch-feed switch assembly 304 is described above as being mounted to and operable in conjunction with the disposer 100 and sink flange assembly, it will be appreciated that the batch-feed switch assembly 304 can be mounted to and operable in conjunction with any food waste disposer unit and/or any other mounting assembly. Furthermore, the batch-feed switch assembly 304 can retrofitted to a pre-existing or newly installed continuous-feed disposer unit, or the batch-feed switch assembly 304 can installed with a disposer unit that is designed and originally installed to be a batch-feed disposer.

It will be appreciated that while the stopper 306 is described above as being movable to a position (i.e., the seal position) that plugs the drain opening and prevents water from draining out of the sink, in some embodiments, the stopper 306 may not be equipped to perform this function. For example, stopper 306 may be a strainer that is received in the draining opening of the sink. Therefore, the terms "stopper" and "activation member," as they are used herein, should not necessarily be limited to structure having the ability to plug the drain of the sink to prevent water from draining out of the sink.

While the batch-feed switch assembly 304 is described above as including the first and second magnets 324, 364 that repel each other when brought into close enough proximity to place the switch unit 310 in the on-position to activate the motor 180, in some embodiments, the magnets 324, 364 and the switch mechanism 362 may be configured such that the magnets 324, 364 attract each other to place the switch unit 310 in the on-position to activate the motor 180.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A food waste disposer system for a sink comprising:

a disposer unit having a food conveying section, a motor section and a grind and discharge section, the food conveying section conveying food waste to the grind section of the grind and discharge section;

the grind section including a grind mechanism, the grind mechanism including a stationary grind ring and a rotating shredder plate assembly that rotates within the stationary grind ring to grind food waste, the rotating shredder plate rotated by a motor of the motor section;

an extension tube from an inlet housing of the food conveying section, the extension tube having an upper end removably securable to a sink flange mounted in the sink and a lower end coupled to the inlet housing of the food conveying section;

a switch unit attached to a tubular body of the extension tube and including a first magnet that is movable relative to the tubular body between a first position in which the switch unit is in a first state allowing activation of the motor and a second position in which the switch unit is in a second state preventing activation of the motor;

an activation member at least partially receivable within the extension tube for relative rotation therebetween, the activation member including a second magnet positioned such that rotational alignment between the first and second magnets causes the first magnet to move to the first position;

a track formed on one of a radially outer surface of the activation member and an inner circumferential portion of the tubular body of the extension tube, the track including a detent; and a protrusion formed on the other of the radially outer surface of the activation member and the inner circumferential portion of the tubular body of the extension tube, the protrusion being adapted to slidably engage the track to facilitate relative rotation between the activation member and the extension tube and be at least partially receivable in the detent to rotationally align the first and second magnets.

2. The food waste disposer system of claim 1, wherein the track includes a first portion, a second portion and a ramp portion interconnecting the first and second portions, and wherein the detent is formed in the second portion.

3. The food waste disposer system of claim 2, wherein the first portion is axially spaced apart from the second portion such that movement of the protrusion from the first portion to the second portion corresponds to movement of the activation member from a sealed position in which liquid is restricted from flowing through the extension tube to an unsealed position in which liquid is allowed to flow through the extension tube.

4. The food waste disposer system of claim 3, wherein the second portion of the track includes a second detent, and wherein when the protrusion is received in the second detent, the activation member is in the unsealed position and the first and second magnets are rotationally misaligned such that the switch unit will be in the second state.

5. The food waste disposer system of claim 1, wherein the activation member includes a handle.

6. The food waste disposer system of claim 1, further comprising a ring coupling the extension tube with the inlet housing.

7. The food waste disposer system of claim 6, wherein the ring includes a plurality of slots adapted to receive a plurality of corresponding feet extending from the extension tube.

8. The food waste disposer system of claim 7, wherein the feet and the slots include mating inclined surfaces that cooperate to act as a threaded connection to tightly secure the extension tube to the ring and the inlet housing.

9. The food waste disposer system of claim 7, wherein the ring engages an outer circumferential surface of the inlet housing.

10. The food waste disposer system of claim 7, wherein the ring includes a resiliently flexible locking arm having a locking tab that selectively engages a second protrusion extending radially outward from the lower end of the extension tube.

11. The food waste disposer of claim 10, wherein the second protrusion includes a ramped surface and an engagement surface, and wherein the locking tab includes an engagement surface that abuts the engagement surface of the second protrusion to restrict relative rotational motion between the ring and the extension tube.

12. The food waste disposer of claim 7, wherein the ring includes two separate ring portions matingly engaging each other.

13. The food waste disposer of claim 7, wherein the ring includes a slit allowing the ring to resiliently flex in a manner that increases an inner diameter of the ring to snap the ring over a flange portion of the inlet housing.

14. The food waste disposer of claim 1 wherein when the first and second magnets are aligned, ends of the first and second magnets having a same polarity face each other so that the first and second magnets repel each other.

* * * * *